US006769407B2

(12) United States Patent
Cotton, III

(10) Patent No.: US 6,769,407 B2
(45) Date of Patent: Aug. 3, 2004

(54) FUEL INJECTOR HAVING MULTIPLE ELECTRICAL ACTUATORS AND A METHOD FOR INSTALLING THE FUEL INJECTOR IN AN ENGINE

(75) Inventor: Clifford E. Cotton, III, Pontiac, IL (US)

(73) Assignee: Caterpillar Inc, Peoria, IL (US)

( * ) Notice: Subject to any disclaimer, the term of this patent is extended or adjusted under 35 U.S.C. 154(b) by 77 days.

(21) Appl. No.: 10/210,809

(22) Filed: Jul. 31, 2002

(65) Prior Publication Data

US 2004/0020468 A1 Feb. 5, 2004

(51) Int. Cl.[7] ..... F02M 37/04
(52) U.S. Cl. ..... 123/470; 239/585.1; 439/130
(58) Field of Search ..... 123/470; 239/585.1; 439/130

(56) References Cited

U.S. PATENT DOCUMENTS

| | | | | | |
|---|---|---|---|---|---|
| 4,844,036 | A | | 7/1989 | Bassler et al. | |
| 4,856,713 | A | * | 8/1989 | Burnett | 239/113 |
| 4,857,003 | A | | 8/1989 | Hafner et al. | |
| 4,922,880 | A | * | 5/1990 | Seibt et al. | 123/509 |
| 4,950,171 | A | | 8/1990 | Muzslay | |
| 5,030,116 | A | | 7/1991 | Sakai et al. | |
| 5,058,554 | A | | 10/1991 | Takeda et al. | |
| 5,127,382 | A | | 7/1992 | Imoehl | |
| 5,347,969 | A | | 9/1994 | Gmelin et al. | |
| 5,460,329 | A | * | 10/1995 | Sturman | 239/96 |
| 5,494,219 | A | * | 2/1996 | Maley et al. | 239/88 |
| 5,568,798 | A | | 10/1996 | Lorraine | |
| 5,584,704 | A | | 12/1996 | Romann et al. | |
| 5,607,315 | A | | 3/1997 | Bonnah, II et al. | |
| 5,616,037 | A | | 4/1997 | Lorraine et al. | |
| 5,638,781 | A | * | 6/1997 | Sturnman | 123/90.12 |
| 5,893,351 | A | | 4/1999 | Akutagawa et al. | |
| 5,934,253 | A | | 8/1999 | Kojima et al. | |
| 6,036,120 | A | * | 3/2000 | Varble et al. | 239/585.1 |
| 6,073,862 | A | * | 6/2000 | Touchette et al. | 239/96 |
| 6,083,015 | A | | 7/2000 | Vargas et al. | |
| 6,227,166 | B1 | * | 5/2001 | Mack | 123/446 |
| 6,575,126 | B2 | * | 6/2003 | Sturman | 123/90.11 |
| 2002/0029765 | A1 | * | 3/2002 | Giavi et al. | 123/490 |
| 2002/0130192 | A1 | * | 9/2002 | Mccoy et al. | 239/585.1 |

* cited by examiner

*Primary Examiner*—Thomas N. Moulis
(74) *Attorney, Agent, or Firm*—Liell & McNeil

(57) ABSTRACT

The present invention relates to a fuel injector having at least two electrical actuators at least partially positioned within a fuel injector body, and a method for installing the fuel injector in an engine. Two pairs of electrical conductors are exposed on an outer surface of the fuel injector body and are arranged in a predetermined pattern relative to one another. Each pair of electrical conductors of the fuel injector is electrically connected to its respective electrical actuator. A wiring harness includes a connector that also has two pairs of electrical conductors. The two pairs of electrical conductors of the wiring harness are connected to the two pairs of electrical conductors of the fuel injector, at least in part, by attaching the connector to the fuel injector.

19 Claims, 3 Drawing Sheets

FUEL INJECTOR HAVING MULTIPLE ELECTRICAL ACTUATORS AND A METHOD FOR INSTALLING THE FUEL INJECTOR IN AN ENGINE

TECHNICAL FIELD

This invention relates generally to fuel injectors in engines, and more particularly to a method for installing fuel injectors with at least two electrical actuators in the engine.

BACKGROUND

In some diesel engines today, there are a plurality of fuel injectors, each having only one electrical actuator. The electrical actuator can be coupled to an electronic controller, in part, by attaching one connector containing electrical leads to each fuel injector. For instance, a one-electrical actuator fuel injector such as that shown in U.S. Pat. No. 5,616,037 issued to Lorraine et al., on Apr. 1, 1997, requires only one electrical connection for each fuel injector.

While the method of utilizing one wiring connector for each electrical actuator has performed well in fuel injectors with one electrical actuator, the method may need improvement for fuel injectors with more than one electrical actuator. It is becoming more common to install in diesel engines fuel injectors having multiple electrical actuators. For instance, in several diesel engines, there are a plurality of fuel injectors having two electrical actuators located at two different positions within the fuel injector. Each electrical actuator includes a solenoid or other device, i.e., piezo that, at least partially, controls a valve within the fuel injector. A first electrical actuator is positioned in an upper portion of the fuel injector and, ultimately, controls the movement of a plunger in the fuel injector. When the plunger advances, fuel within the fuel injector can be compressed. A second electrical actuator is positioned in a lower portion of the fuel injector and controls, in part, the timing of injection events. A wiring harness is in electrical communication with an electronic controller. If each electrical actuator must be electrically connected to the wiring harness via its own electrical connector and electrical leads, there will be two wiring connectors that must be attached at two different locations on the fuel injector.

If a connector is attached to the electrical actuator in the upper portion of the fuel injector and a different connector is attached to the electrical actuator in the lower portion of the fuel injector, there exists a possibility that the two connectors will be interchanged. Thus, the upper electrical actuator would be connected to the electrical leads for the lower electrical actuator, and vice versa, causing the fuel injector to malfunction. Further, because the two electrical connections are located at different positions within the fuel injector, the process of attaching the connectors is labor intensive and is not suitable for automated assembly. The lower connector is difficult to connect when the injector is assembled to the engine head with a valve train. Thus, the manufacturing costs for connecting both actuators to the wiring harness is high. Lastly, the prior art, whether it includes a fuel injector having one or two electrical actuators, often utilizes a clip to attach the connectors to their respective electrical actuators. However, over time, the engine vibrations loosen the electrical connection between the connectors and the electrical actuators, causing the fuel injector to malfunction.

The present invention is directed to overcoming one or more of the problems as set forth above.

SUMMARY OF THE INVENTION

In one aspect of the present invention, a fuel injector includes a fuel injector body in which a first electrical actuator and a second electrical actuator are at least partially positioned. Outside an outer surface of the fuel injector body, a first pair of electrical conductors and a second pair of electrical conductors are exposed in a predetermined pattern relative to one another. The first electrical actuator and the first pair of electrical conductors are electrically connected to a first electrical circuit. The second electrical actuator and the second pair of electrical conductors are electrically connected to a second electrical circuit.

In another aspect of the present invention, an engine includes an engine housing to which at least one fuel injector is attached. The fuel injector includes a fuel injector body in which a first electrical actuator and a second electrical actuator are at least partially positioned. A first pair of electrical conductors and a second pair of electrical conductors are exposed outside an outer surface of the fuel injector body. The first electrical actuator and the first pair of electrical conductors are electrically connected to a first electrical circuit. The second electrical actuator and the second pair of electrical conductors are electrically connected to a second electrical circuit. A connector of a wiring harness is attached to the fuel injector. The connector includes a first pair of electrical conductors and a second pair of electrical conductors that are electrically connected to the first pair of electrical conductors and the second pair of electrical conductors of the fuel injector, respectively.

In yet another aspect of the present invention, there is a method for installing a fuel injector in an engine. The fuel injector is attached to an engine housing. There are two pairs of electrical conductors exposed outside an outer surface of a fuel injector body. A connector of a wiring harness is attached to the fuel injector, at least, in part, by connecting a first pair of electrical conductors and a second pair of electrical conductors of the wiring harness to a first pair of electrical conductors and a second pair of electrical conductors of the fuel injector, respectively.

DETAILED DESCRIPTION

Figure 1:
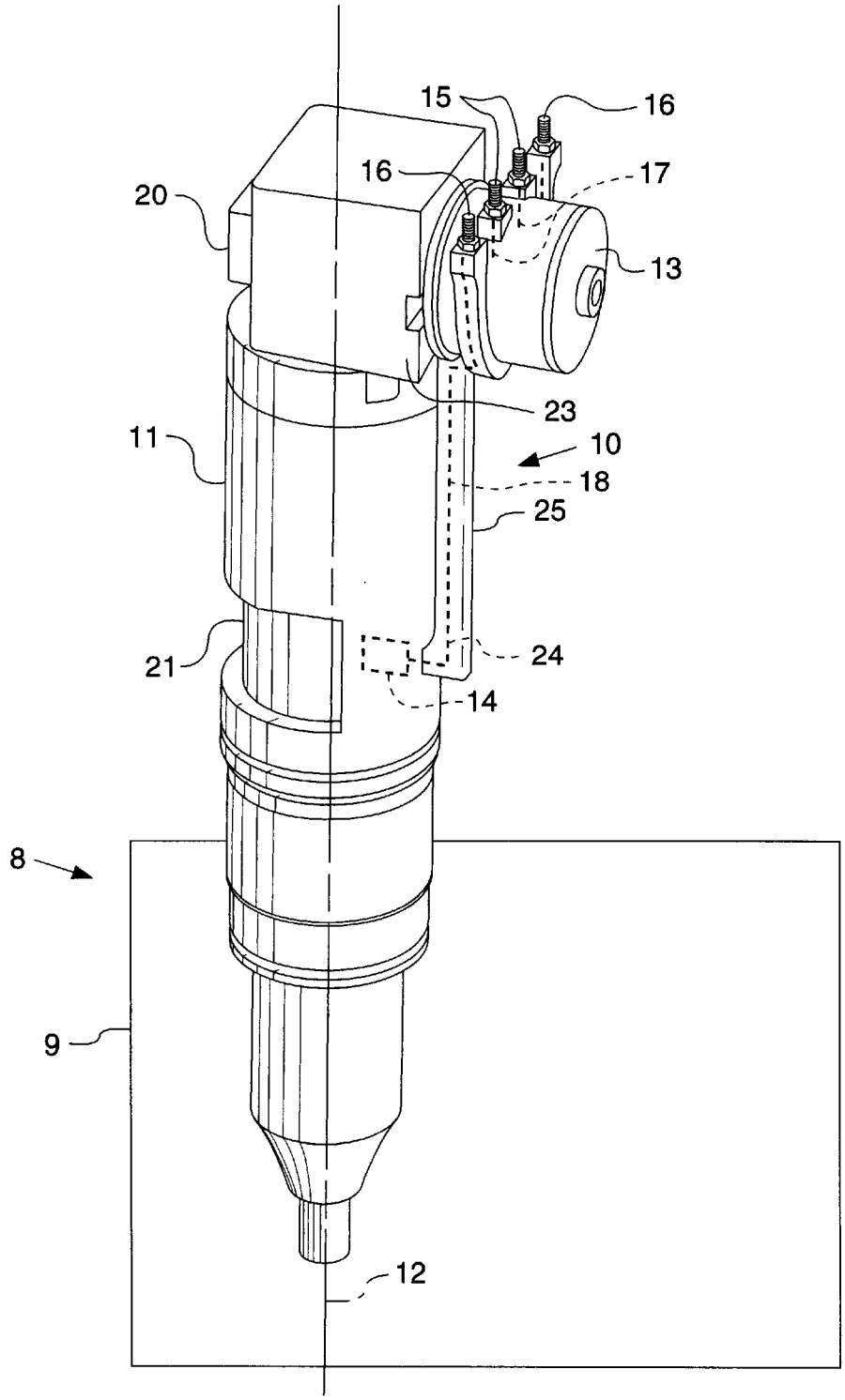
FIG. 1 is a diagrammatic isometric view of a fuel injector and engine according to the present invention.

Referring to FIG. 1, there is shown a diagrammatic isometric view of a fuel injector 10 attached to an engine 8 according to the present invention. Although there are a plurality of fuel injectors 10 within the engine 8, the present invention is described for one fuel injector 10. It should be appreciated that the present invention performs similarly for each fuel injector 10 within the engine 8. The fuel injector 10 includes a fuel injector body 11 which is attached to an engine housing 9 of the engine 8. A first electrical actuator 13 and a second electrical actuator 14 are, at least, partially positioned within the fuel injector body 11. Although those skilled in the art will appreciate that there may be more than two electrical actuators within the fuel injector 10 and the electrical actuators may be positioned at different locations within the fuel injector 10, the present invention is described for the two-electrical actuator fuel injector 10 in which the first electrical actuator 13 is positioned in an upper portion 20 of the fuel injector body 11 and the second electrical actuator is positioned in a lower portion 21 of the fuel injector body 11. A first pair of electrical conductors 15 and a second pair of electrical conductors 16 are exposed outside an outer surface 23 of the fuel injector body 11. Both pairs of electrical conductors 15, 16 have a predetermined orientation relative to the engine housing 9. Although the predetermined orientation could be any orientation that permits automated installation of the fuel injector 10 into the engine 8, the present invention preferably orientates both pairs of electrical conductors 15, 16 relative to the engine housing 9 such that the electrical conductors 15, 16 are vertical.

The first pair of electrical conductors 15 and the first electrical actuator 13 are electrically connected to a first electrical circuit 17. The first electrical circuit 17 includes the first electrical actuator, such as a solenoid, that controls a valve within the upper portion 20 of the fuel injector 10. The second pair of electrical conductors 16 and the second electrical actuator 14 are electrically connected to a second electrical circuit 18. The second electrical circuit 18 includes an electrically conductive element 24, preferably a wire, disposed in an insulative material 25 that extends outside the fuel injector 10 between the upper portion 20 and the lower portion 21 of the fuel injector body 11. Although those skilled in the art will appreciate that the electrically conductive element 24 could be disposed in any insulative material, the present invention preferably uses plastic as the insulative material 25 due to its resistance to chemicals in the oil, its ability to withstand thermal cycling, and its ability to bond with the electrically conductive element 24. The second electrical circuit 18 also includes the second electrical actuator, such as a solenoid, that controls a valve within the lower portion 21 of the fuel injector 10. Other electrical actuators, such as piezos, voice coils, etc. are contemplated by the present invention.

Figure 2:
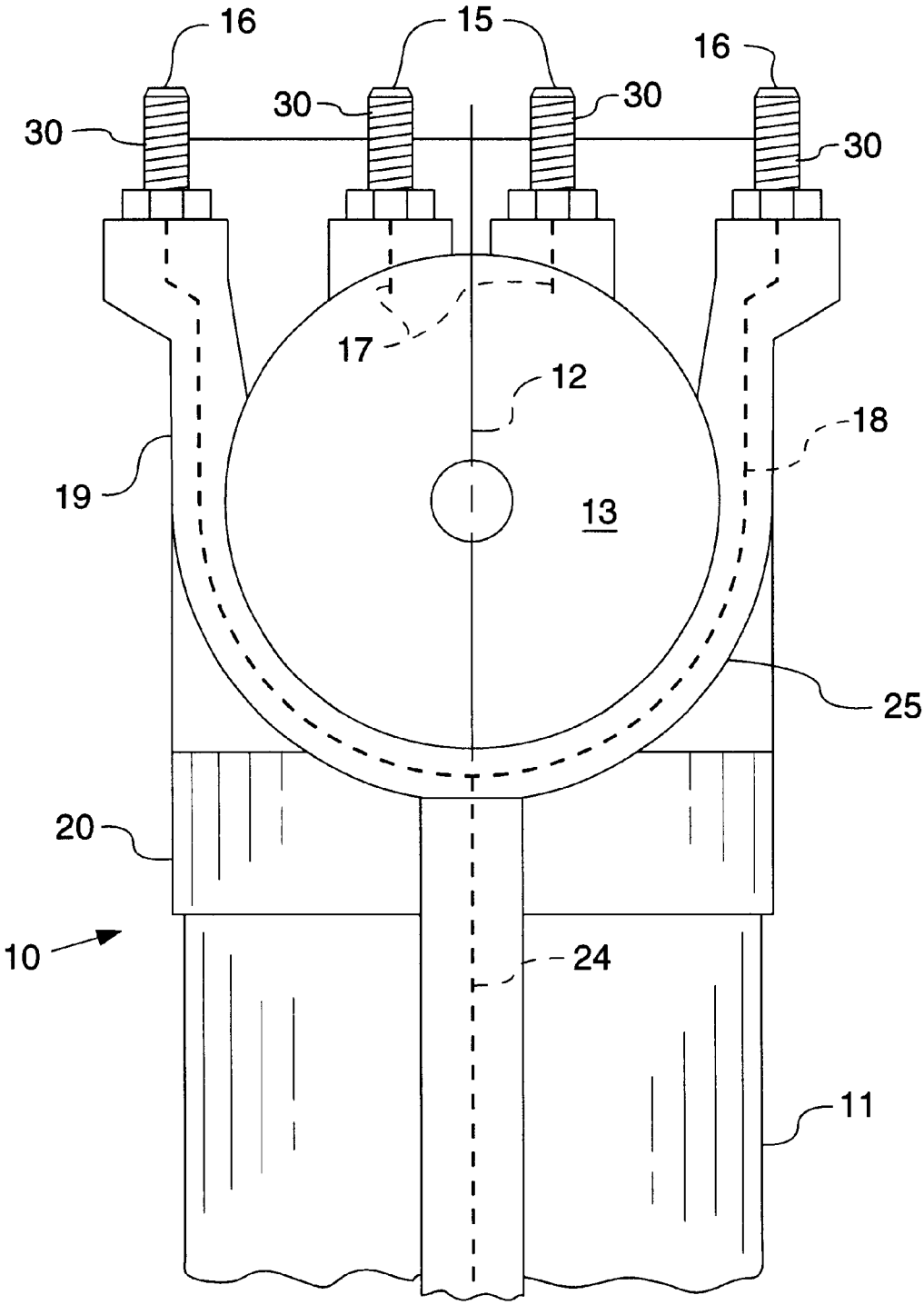
FIG. 2 is a diagrammatic front view of an upper portion of the fuel injector of FIG. 1 according to the present invention.

Referring to FIG. 2, there is shown a front view of the upper portion 20 of the fuel injector 10 of FIG. 1 according to the present invention. The second electrical circuit 18 includes a clip 19 that preferably mates to the outer cylindrical surface of the first electrical actuator 13 on the outer surface 23 of the fuel injector body 11. It should be appreciated that the clip 19 could mate to any feature on the outer surface 23 of the fuel injector body 11. Further, it should be appreciated that there are other methods for attaching the second electrical circuit 18 to the outside of the outer surface 23 of the fuel injector body 11, such as using suitable adhesives or molding. The first pair of electrical conductors 15 and the second pair of electrical conductors 16 include posts that preferably have a threaded outer surface 30. The posts are comprised of an electrically conductive material, preferably a metal, and are electrically connected to their respective electrical circuits 17, 18. Alternatively, it should be appreciated that both pairs of electrical conductors 15, 16 could include plates of electrically conductive material, preferably a metal, defining a connector bore and being electrically connected to their respective electrical circuits 17, 18.

The first pair of electrical conductors 15 and the second pair of electrical conductors 16 are oriented in a predetermined pattern to one another. The predetermined pattern acts as an unique mating feature between the fuel injector 10 and a wiring harness 32 (shown in FIG. 3) preventing misconnection between the first pair of electrical conductors 15 and the second pair of electrical conductors 16. The first pair of electrical conductors 15 and the second pair of electrical conductors 16 are preferably oriented parallel to one another and to a centerline 12 of the fuel injector 10. The first pair of electrical conductors 15 and the second pair of electrical conductors 16 are preferably positioned in a straight line. The first pair of electrical conductors 15 are preferably spaced relatively close to one another, whereas the second pair of electrical conductors 16 are preferably spaced relatively far from one another. Although the present invention utilizes the predetermined pattern as the unique mating feature preventing misconnection, it should be appreciated that other unique mating features, such as a key or raised surface could be used to prevent misconnection. Further, it should be appreciated that other orientation patterns of both pairs of electrical conductors 15, 16 that prevent misconnection could be utilized, such as an elongated diamond shape.

Figure 3:
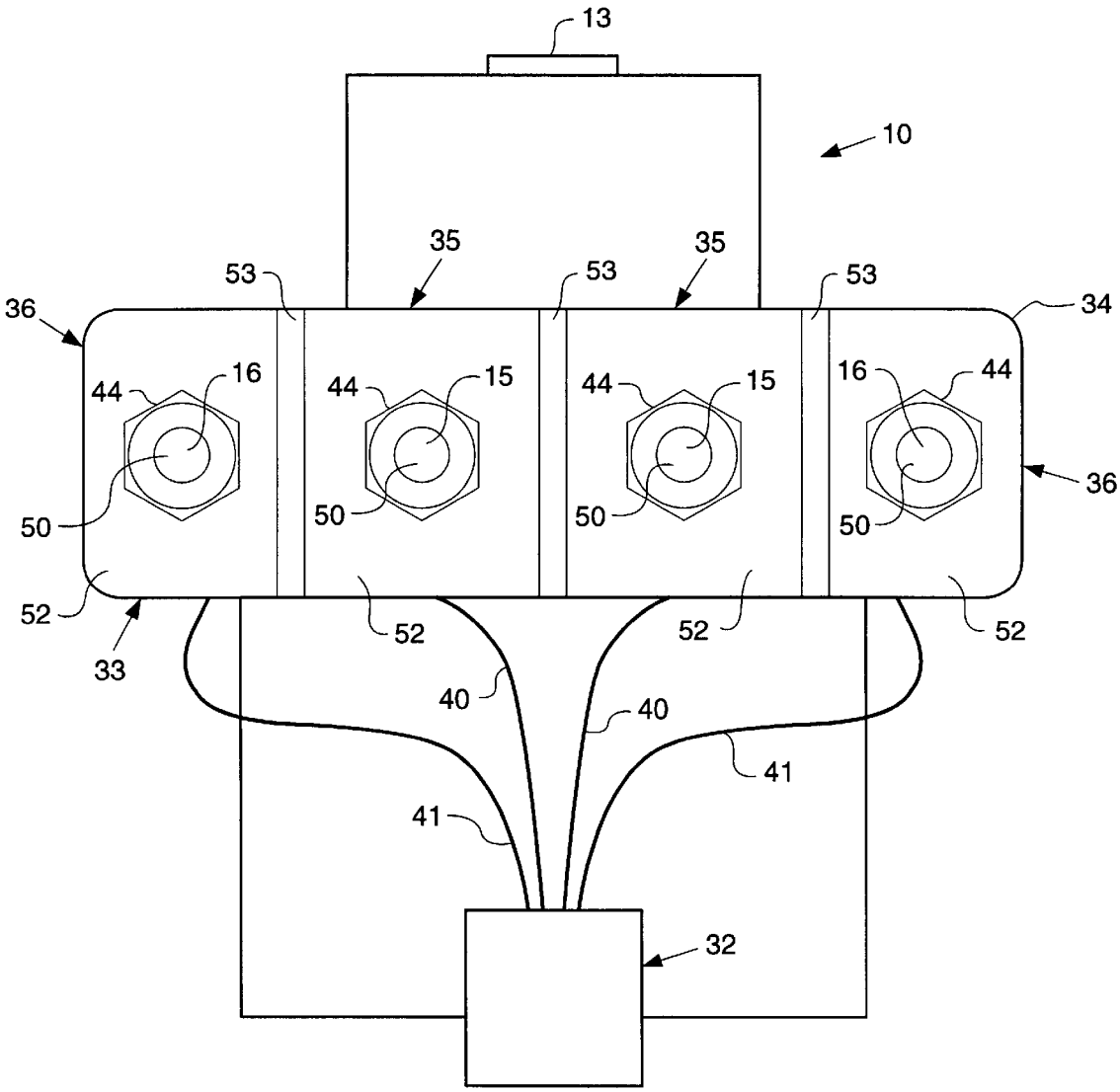
FIG. 3 is a diagrammatic representation of a top view of a wiring harness connected to the fuel injector of FIG. 2 according to the present invention.

Referring to FIG. 3, there is shown a diagrammatic representation of a top view of the wiring harness 32 connected to the fuel injector of FIG. 2 according to the present invention. The wiring harness 32 is attached to the engine housing 9 (shown in FIG. 1) and electrically connected to the fuel injector 10 via the connector 33. The connector 33 includes an outer surface 34 comprised of an insulative material. Although those skilled in the art will appreciate any insulative material could be used, the present invention preferably uses plastic due to its resistance to chemicals in the oil, its ability to withstand thermal cycling, and its ability to bond with the electrically conductive materials. The connector 33 of the wiring harness 32 includes a first pair of electrical conductors 35 and a second pair of electrical conductors 36. Each electrical conductor in each pair of conductors 35, 36 includes a conductor bore 50 defined by a plate 52 of electrically conductive material, preferably metal. The wiring harness 32 is electrically connected to the first pair of electrical conductors 35 and the second pair of electrical conductors 36 of the connector 33 via a first pair of electrical leads 40 and a second pair of electrical leads 41, respectively. Each pair of electrical leads 40, 41 are comprised of an electrically conductive element contained within an insulative material, preferably plastic. The electrical leads 40, 41 are preferably molded into the insulative outer surface 34 such that they have electrical contact with the metal plates 52. The metal plates 52 and the insulative outer surface 34 define three air gaps 53 that prevent the flow of electrical current between the first pair of electrical conductors 35 and the second pair of electrical conductors 36, resulting in short circuiting. It should be appreciated that the crossing of electrical current between the pairs of electrical conductors 35, 36 can also be prevented by positioning any insulative material between the four metal plates 52.

The first pair of electrical conductors 35 and the second pair of electrical conductors 36 of the wiring harness 32 are electrically connected to the first pair of electrical conductors 15 and the second pair of electrical conductors 16 of the fuel injector 10, respectively. Thus, the first pair of electrical conductors 35 and the second pair of electrical conductors 36 of the wiring harness 32 are in the same predetermined pattern relative to one another as the first pair of electrical conductors 15 and the second pair of electrical conductors 16 of the fuel injector 10. Therefore, both pairs of electrical conductors 35, 36 of the wiring harness 32 are in a straight line and are oriented parallel to one another. Further, the first pair of electrical conductors 35 are spaced relatively close to one another, and the second pair of electrical conductors 36 are spaced relatively far from one another. The conductor bores 50 of the first pair 35 and second pair 36 of electrical conductors mate with the threaded outer surfaces 30 of the first pair 15 and second pair 16 of electrical conductors of the fuel injector 10. Each electrical conductor 35, 36 includes a threaded fastener 44 that is positioned on a top surface of the connector 33 and mates with the threaded outer surface 30 of both pairs of electrical conductors 15, 16 of the fuel injector 10. Fasteners 44 are also preferably made from an electrically conductive material.

Alternatively, the first pair of electrical conductors and the second pair of electrical conductors of the wiring harness could include posts with threaded outer surfaces, and the first pair of electrical conductors and the second pair of electrical conductors of the fuel injector could include conductor bores defined by metal plates and threaded fasteners. The threaded outer surfaces of the first pair and second pair of electrical conductors of the connector would mate with the inner surfaces of the conductor bores of the first pair and second pair of the electrical conductors of the fuel injector. In addition, the threaded fasteners would mate to the threaded outer surface of the first pair and second pair electrical conductors of the connector.

INDUSTRIAL APPLICABILITY

During the assembly of the fuel injector 10 with at least two electrical actuators 13, 14, the first pair of electrical conductors 15 are spaced relatively close to one another and are attached to the first electrical actuator 13 that is partially positioned on the outside of the outer surface 23 of the upper portion 20 of the fuel injector body 11. The first pair of electrical conductors 15 will be in electrical communication with the first electrical circuit 17, including the solenoid that controls a valve within the fuel injector. The second pair of electrical conductors 16 are attached to the electrically conductive element 24 disposed within the insulative material 25, preferably plastic. The second pair of electrical conductors 16 are attached to the outer surface 23 of the fuel injector body 11, in part, by mating the clip 19 formed by the electrically conductive element 24 within the insulative material 25 to the first electrical actuator 13. The electrically conductive element 24 disposed within the insulative material 25 also extends between the upper portion 20 and the lower portion 21 of the fuel injector body 10, and through the fuel injector body 11 connecting the second electrical actuator 14 to the second pair of electrical conductors 16. Although the electrically conductive element 24 disposed within the insulative material 25 extends parallel to the centerline 12 of the fuel injector 10, it could extend any direction in order to connect the second electrical actuator 14 and the second pair of electrical connectors 16. Thus, the second pair of electrical conductors 16 are spaced relatively far from one another and are electrically connected to the second electrical actuator 16 via a second electrical circuit 18 that includes the electrically conductive element 24 disposed within the insulative material 25. The fuel injector 10 is attached to the engine housing 9 in a conventional manner.

During the assembly of the engine 8, each electrical actuator 13, 14 of each fuel injector 10 must be coupled to the electronic controller via the wiring harness 32. Although the present invention is described utilizing the wiring harness 32, those skilled in the art should appreciate that other types of electrical couplers could be used to establish communication between the connector 33 and the electronic controller. Although there may be only one wiring harness 32 connecting a plurality of fuel injectors 10 or a plurality of engine components to the electronic control module, the wiring harness 32 preferably includes only one connector 33 for each fuel injector 10. The connector 33 establishes electrical communication between the wiring harness 32 and the first electrical actuator 13 and the second electrical actuator 14 of the fuel injector 10. Because the first pair 15 and the second pair 16 of electrical conductors of the fuel injector 10 are oriented vertically, the attachment of the connector 33 to the fuel injector 10 can be automated rather than manual.

A human and/or machine will lower the first pair 35 and second pair 36 of electrical conductors of the connector 33 onto the first pair 15 and second pair 16 of electrical conductors of the fuel injector 10. Simultaneously or shortly thereafter, a human and/or machine, such as a robot, will also lower the threaded fasteners 44 positioned on the top surface of the connector 33. The preferably vertical orientation of the posts 30 should better enable the use of robots in the assembly process of the wiring harness 32 to the fuel injector(s) 10. The threaded inner surfaces of the fasteners 44 will mate with each electrical conductor 15, 16 of the fuel injector 10 to secure the connection between the connector 33 and the fuel injector 10. Those skilled in the art should appreciate that the mating of the electrical conductors 35, 36 of the connector 33 to the electrical conductors 15, 16 of the fuel injector 10 and the mating of the fasteners 44 to the electrical conductors 15, 16 of the fuel injector 10 can be accomplished simultaneously by one lowering of both the connector 33 and the fasteners 44. Alternatively, both matings can be accomplished in two steps with a first lowering of the connector 33 and then a second lowering of the fasteners 44. Because the first pair 35 and second pair 36 of electrical conductors of the connector 33 are orientated in the same unique mating pattern as the first pair 15 and second pair 16 of electrical conductors of the connector 33, the first pair of electrical conductors 15 and the second pair of electrical conductors 16 of the fuel injector 10 will be electrically connected to the first pair of electrical conductors 35 and the second pair of electrical conductor 36 of the connector 33, respectively. Further, because the direction of the flow of electrical current is inconsequential to the functioning of the electrical actuators 13, 14, the rotation of the connector 33 180° will not result in malfunctioning of the electrical actuators 13, 14. If polarity were important, geometrical or other features could be included on fuel injector 10 and/or connector 33 to prevent a misconnection.

Alternatively, electrically connecting the first pair and second pair of the electrical conductors of the connector to the first pair and second pair of the electrical conductors of the fuel injector to one another can be accomplished by comprising the electrical conductors of the connector of posts with threaded outer surfaces and the electrical conductors of the fuel injector of conductor bores defined by plates of electrically conductive material, preferably metal. Preferably, a machine would lower the posts of the connector onto the fuel injector, such that the outer threaded surfaces of the posts mate with the inner surfaces of the conductor bores. A machine would mate the inner threaded surfaces of the fasteners to the outer threaded surfaces of the posts on the bottom surface of the connector.

Once the connector 33 of the wiring harness 32 is electrically connected to the fuel injector 10, the electronic controller can control both the first electrical actuator 13 and the second electrical actuator 14 through the connector 33. In order to activate the first electrical actuator 13, electric current is passed through the first pair of electrical leads 40 to the metal plates 52 of the first pair of electrical conductors 35 of the connector 33 to the posts of the first pair of electrical conductors 15 of the fuel injector 10. The electrical current will then flow through the first electrical circuit 17, including the solenoid, to energize the first electrical actuator 13. In order to activate the second electrical actuator 14, electric current is passed through the second pair of electrical leads 41 through the metal plates 52 of the second pair of electrical conductors 36 of the connector 33 to the posts of the second pair of electrical conductors 16 of the fuel injector 10. The electric current flows to the second electrical actuator 14 in the lower portion 21 of the fuel injector 10 via the second electrical circuit 18, including the electrically conductive element 24 disposed within the insulative material 25. Because of the three air gaps 53 included in the connector 33, the electric current does not jump from the first pair of electrical conductors 35 to the second pair of electrical conductors 36, and vice versa.

Overall, the present invention is advantageous because it can reduce the need for a separate connector for each actuator in a fuel injector, regardless of the placement of the electrical actuators within the fuel injector. Whereas the prior art might attempt to utilize two connectors for the fuel injector 10 with two electrical actuators 13, 14, the first 13 being positioned in the upper portion 20 of the fuel injector 10 and the second being positioned in the lower portion 21 of the fuel injector 10, the present invention utilizes one connector 33. The fact that there is only one connector 33 reduces the possibility of misconnection between the two connectors and the two actuators. For instance, an individual could connect the first connector with the second electrical actuator 14 and the second connector with the first electrical actuator 14, causing the fuel injector 10 to malfunction. Although the prior art could utilize color coated or keyed connectors to prevent misconnection, utilizing only one connector 33 for each fuel injector 10 is likely more effective and less expensive. Further, the present invention utilizing one connector 33 for each fuel injector 10 and orientating the first pair 15 and second pair 16 of electrical conductors vertically is advantageous because it better facilitates automated, rather than manual, attachment of the wiring harness 32 to the fuel injector 10. This will further reduce the cost of manufacturing and reduce the risk of misconnection. The risk of misconnection is also reduced by the predetermined pattern of the first pair 15 and second pair 16 of electrical conductors of the fuel injector 10. Even if the connector 33 is rotated 180°, the first pair 35 and the second pair 36 of electrical conductors of the wiring harness 33 will connect with the first pair 15 and second pair 16 of electrical conductors of the fuel injector 10, respectively.

The present invention is advantageous because it utilizes posts with threaded outer surfaces 30 as electrical conductors and fasteners 44 with threaded inner surfaces that mate to each post. Regardless of whether the fuel injector 10 or the wiring harness 32 includes the posts with the threaded outer surfaces, this method of securing the connection between the wiring harness 32 and the fuel injector 10 is more robust and can withstand more engine vibrations than the prior art's utilization of a clip. In addition, because posts 30 are arranged in a predetermined pattern relative to one another, connectors 33 having an uniform geometry can be utilized.

It should be understood that the above description is intended for illustrative purposes only, and is not intended to limit the scope of the present invention in any way. Thus, those skilled in the art will appreciate that other aspects, objects, and advantages of the invention can be obtained from a study of the drawings, the disclosure and the appended claims.

What is claimed is:

1. A fuel injector comprising: a fuel injector body;

a first pair of electrical conductors and a second pair of electrical conductors exposed outside an outer surface of the fuel injector body in a predetermined pattern relative to one another that includes unique mating features that prevent misconnection;

a first electrical actuator and a second electrical actuator at least partially positioned within the fuel injector body;

a first electrical circuit being electrically connected to the first pair of electrical conductors and the first electrical actuator; and a second electrical circuit being electrically connected to the second pair of electrical conductors and a second electrical actuator.

2. The fuel injector of claim 1 wherein A fuel injector comprising:

a fuel injector body;

a first pair of electrical conductors and a second pair of electrical conductors exposed outside an outer surface of the fuel injector body in a predetermined pattern relative to one another;

a first electrical actuator and a second electrical actuator at least partially positioned within the fuel injector body;

a first electrical circuit being electrically connected to the first pair of electrical conductors and the first electrical actuator;

a second electrical circuit being electrically connected to the second pair of electrical conductors and a second electrical actuator; and the second electrical circuit includes an electrically conductive element disposed within an insulative material extending outside the fuel injector body between an upper portion of the fuel injector body and a lower portion of the fuel injector body.

3. The fuel injector of claim 2 wherein the second electrical circuit includes a clip that mates to a feature on the outer surface of the fuel injector body.

4. The fuel injector of claim 1 wherein the first pair of electrical conductors and the second pair of electrical conductors are oriented parallel to one another.

5. The fuel injector of claim 4 wherein the first pair of electrical conductors and the second pair of electrical conductors lie in a straight line.

6. The fuel injector of claim 4 wherein the first pair of electrical conductors being spaced relatively close to one another; and the second pair of electrical conductors being spaced relatively far from one another.

7. The fuel injector of claim 6 wherein the first pair of electrical conductors and the second pair of electrical conductors are oriented parallel to a centerline of the fuel injector body.

8. The fuel injector of claim 4 wherein each of the first pair of electrical conductors and each of the second pair of electrical conductors includes a threaded surface.

9. An engine comprising: an engine housing;

at least one fuel injector attached to the engine housing and comprising a fuel injector body; a first pair of electrical conductors and a second pair of electrical conductors exposed outside an outer surface of the fuel injector body; a first electrical actuator and a second electrical actuator at least partially positioned within the fuel injector body; a first electrical circuit being electrically connected to the first pair of electrical conductors and the first electrical actuator; and a second electrical circuit being electrically connected to the second pair of electrical conductors and the second electrical actuator; and a wiring harness including a connector attached to the fuel injector; and the connector comprising a first pair of electrical conductors and a second pair of electrical conductors that are electrically connected to the first pair of electrical conductors and the second pair of electrical conductors of the fuel injector, respectively;

at least one of the wiring harness and the fuel injector including unique mating features that prevent misconnection.

10. The engine of claim 9 wherein the first pair of electrical conductors and the second pair of electrical conductors of the fuel injector have a predetermined orientation relative to the engine housing.

11. The engine of claim 10 wherein the second electrical circuit includes an electrically conductive element disposed within an insulative material extending outside the fuel injector body between an upper portion of the fuel injector body and a lower portion of the fuel injector body.

12. The engine of claim 11 wherein the first pair of electrical conductors and the second pair of electrical conductors of the fuel injector are oriented parallel to one another;

the first pair of electrical conductors of the fuel injector are spaced relatively close to one another; and the second pair of electrical conductors of the fuel injector are spaced relatively far from one another.

13. The engine of claim 12 wherein the second electrical circuit includes a clip that mates to a feature on the outer surface of the fuel injector body.

14. The engine of claim 13 wherein the first pair of electrical conductors and the second pair of electrical conductors of at least one of the wiring harness and the fuel injector includes a threaded outer surface; and the first pair of electrical conductors and the second pair of electrical conductors of the other of the wiring harness and the fuel injector includes an threaded inner surface that mates with the threaded outer surface.

15. The engine of claim 14 wherein the first pair of electrical conductors and the second pair of electrical conductors of the fuel injector comprise posts with the threaded outer surface; and the wiring harness include a threaded fastener that mates to each respective post.

16. A method for installing a fuel injector in an engine comprising the steps of:

attaching to an engine housing a fuel injector including two pairs of electrical conductors exposed outside an outer surface of a fuel injector body; and connecting a first pair of electrical conductors and a second pair of electrical conductors of a wiring harness to a first pair of the electrical conductors and a second pair of the electrical conductors of the fuel injector, respectively, at least in part by attaching a connector of the wiring harness to the fuel injector;

preventing misconnection by providing unique mating features between the fuel injector and the connector of the wiring harness.

17. The method of claim 16 wherein the step of connecting includes a step of simultaneously electrically connecting the first pair of electrical conductors and the second pair of electrical conductors of the fuel injector to the first pair of electrical conductors and the second pair of electrical conductors of the wiring harness, respectively.

18. A method for installing a fuel injector in an engine comprising the steps of:

attaching to an engine housing a fuel injector including two pairs of electrical conductors exposed outside an outer surface of a fuel injector body:

connecting a first pair of electrical conductors and a second pair of electrical conductors of a wiring harness to a first pair of the electrical conductors and a second pair of the electrical conductors of the fuel injector, respectively, at least in part by attaching a connector of the wiring harness to the fuel injector;

the step of connecting includes a step of simultaneously electrically connecting the first pair of electrical conductors and the second pair of electrical conductors of the fuel injector to the first pair of electrical conductors and the second pair of electrical conductors of the wiring harness, respectively; and the step of electrically connecting includes a step of simultaneously mating a threaded surface of the first pair of electrical conductors and the second pair of electrical conductors of the fuel injector with the threaded surface of the first pair of electrical conductors and the second pair of electrical conductors of the wiring harness, respectively.

19. The method of claim 18 wherein the step of attaching includes a step of orientating the first pair of electrical conductors and the second pair of electrical conductors of the fuel injector vertically.

* * * * *